US007854372B1

(12) United States Patent
Bartone, Sr.

(10) Patent No.: US 7,854,372 B1
(45) Date of Patent: Dec. 21, 2010

(54) BOX CLOSURE CLIP

(76) Inventor: John A Bartone, Sr., 625 E. 29th St., Erie, PA (US) 16504

( * ) Notice: Subject to any disclaimer, the term of this patent is extended or adjusted under 35 U.S.C. 154(b) by 0 days.

(21) Appl. No.: 12/322,272

(22) Filed: Jan. 29, 2009

Related U.S. Application Data

(63) Continuation-in-part of application No. 12/287,419, filed on Oct. 8, 2008, now abandoned.

(51) Int. Cl.
*B65D 43/22* (2006.01)

(52) U.S. Cl. ..... 229/125.39; 24/546; 24/563; 24/570

(58) Field of Classification Search ..... 229/125.39, 229/125.37, 125.41, 126; 292/288; 24/546, 24/561, 563, 570, 910
See application file for complete search history.

(56) References Cited

U.S. PATENT DOCUMENTS

| | | | | | |
|---|---|---|---|---|---|
| 933,454 | A * | 9/1909 | Hudson | 229/125.39 |
| 3,019,500 | A * | 2/1962 | Duffin | 24/561 |
| 3,221,977 | A * | 12/1965 | Pollert | 229/125.41 |
| 3,276,663 | A * | 10/1966 | Falconer | 229/125.39 |
| 3,545,801 | A * | 12/1970 | Barsness | 292/288 |
| 4,019,764 | A * | 4/1977 | Okamura | 292/288 |
| 4,339,983 | A * | 7/1982 | Okamura et al. | 411/466 |
| 5,743,461 | A * | 4/1998 | Timmins | 229/125.39 |
| 6,290,126 | B1 * | 9/2001 | Zudal | 229/125.39 |
| 6,571,538 | B2 * | 6/2003 | Luby | 292/288 |
| 6,619,013 | B2 * | 9/2003 | Dismukes | 53/382.1 |
| 7,284,688 | B1 * | 10/2007 | Barsness | 229/125.39 |
| D575,143 | S * | 8/2008 | Kuo et al. | D8/394 |

FOREIGN PATENT DOCUMENTS

| | | | | |
|---|---|---|---|---|
| DE | 2458725 | A1 * | 6/1975 | 229/125.39 |

* cited by examiner

*Primary Examiner*—Gary E Elkins
(74) *Attorney, Agent, or Firm*—Richard K. Thomson

(57) ABSTRACT

A rectangular box closure clip engages the two top flaps of a shipping container holding them securely without damaging the carton enabling the boxes to be reused without the need for being reformulated. The closure clip includes a pair of lower surfaces and a pair of upper surfaces interconnected by a central web that extends substantially throughout the length of the clip. The edges of the two upper surfaces are set back to facilitate insertion into the box. In a second embodiment, a vertically extending endstop is provided to prevent a box stacked atop the clip from sliding axially relative thereto. In still a third embodiment, a recess allows a binder strap to be installed around the clip to retain it in place. A programmable, scanable chip may be incorporated into the closure clip to facilitate tracking and/or to tamper-proof the package.

9 Claims, 5 Drawing Sheets

BOX CLOSURE CLIP

This application is a continuation-in-part of U.S. patent application Ser. No. 12/287,419 filed Oct. 8, 2008 now abandoned.

BACKGROUND AND SUMMARY OF THE INVENTION

The present invention relates to the field of shipping. More particularly, the present invention relates to a box closure clip which can economically secure closure of shipping containers and permit the recycling of the boxes.

Sealing of cardboard cartons is typically done with shipping tape which, although adequately seals the box, does significant damage when removed rendering the box suitable for the recycle bin. If a suitable sealing technique could be developed which securely fastened the flaps of the container without destroying the box, significant savings could be realized permitting reuse of the container without reprocessing.

A number of attempts have been made to develop a mechanical fastener for shipping containers that do not damage the box. However, none have been commercially successful for a number of reasons. Among those is the failure of some to adequately secure the flaps of the box for shipping. In addition, the majority of those closures which have been developed are too expensive to manufacture and hence, too expensive to use. It is among the objects of the present invention to overcome the deficiencies of these previous attempts.

The box closure clip of the present invention comprises a rectangular clip for retaining multiple flaps of a box closed, the clip including a) a first laterally extending surface having a first length for underlying at least one of the multiple flaps of the box, the first laterally extending surface having a first leading edge; b) a second laterally extending surface having a second length for underlying at least one other of the multiple flaps of the box the second laterally extending surface having a second leading edge; c) a third laterally extending surface having a third length for overlying at least one of the multiple flaps of the box the third laterally extending surface having a third leading edge;

d) a fourth laterally extending surface having a fourth length for overlying at least one other of the multiple flaps of the box the fourth laterally extending surface having a fourth leading edge; e) a generally vertically extending rib interconnecting the first, second, third, and fourth laterally extending surfaces, the rib having a length at least equal to the first length; whereby when the clip is positioned such that the first and second laterally extending surfaces underlie the at least one and the at least one other flaps and the third and fourth laterally extending surfaces overlie the at least one and the at least one other flaps, the multiple flaps of the box are retained in a closed position. Preferably, the first length and the second length are equal, as are the third length and the fourth length. Also, preferably, the first and the third lengths are equal.

In the preferred embodiment, the first and the second leading edges are laterally offset from the third and the fourth leading edges. This facilitates the insertion of the box clip under/over the flaps of the carton. Preferably, the first and second laterally extending surfaces form opposite ends of a first flange from which the generally vertically extending rib projects. Further, the third and the fourth laterally extending surfaces form opposite ends of a second flange into which the generally vertically extending rib projects. In a second embodiment, the box clip includes an end stop extending downwardly from the first flange and upwardly from the second flange to position and stabilize a second box relative to the multiple flaps retained by said clip.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1A:
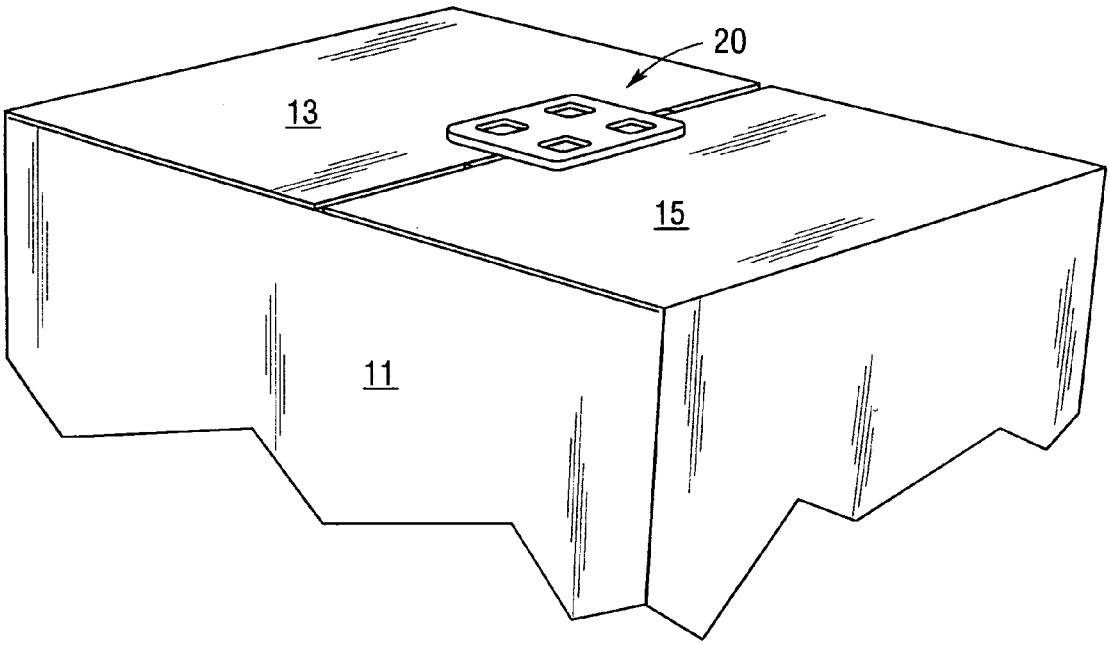
FIG. 1A is a perspective front view of a first embodiment of the box closure clip of the present invention shown securing two flaps of a box.
Figure 1B:
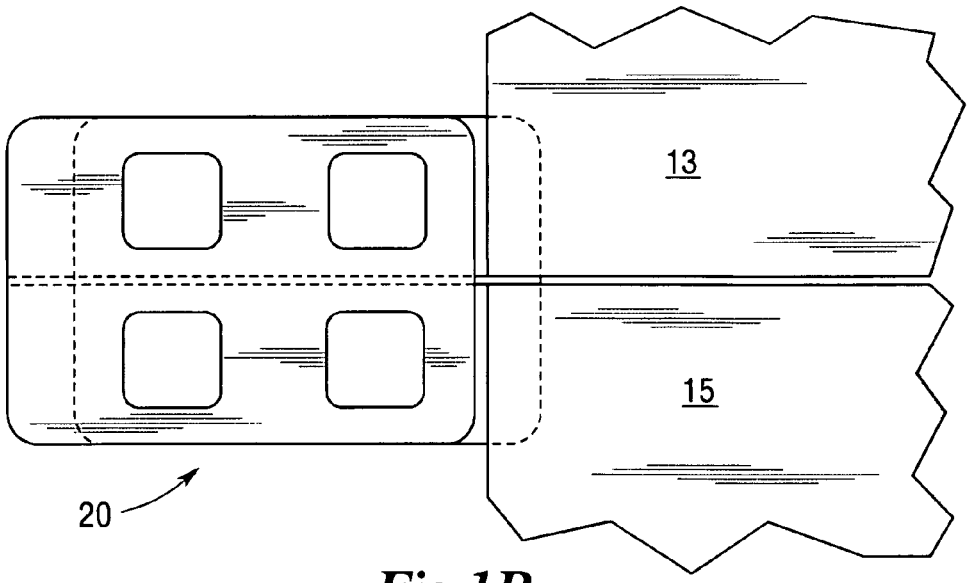
FIG. 1B is a top detail view showing a box closure clip being installed.
Figure 2:
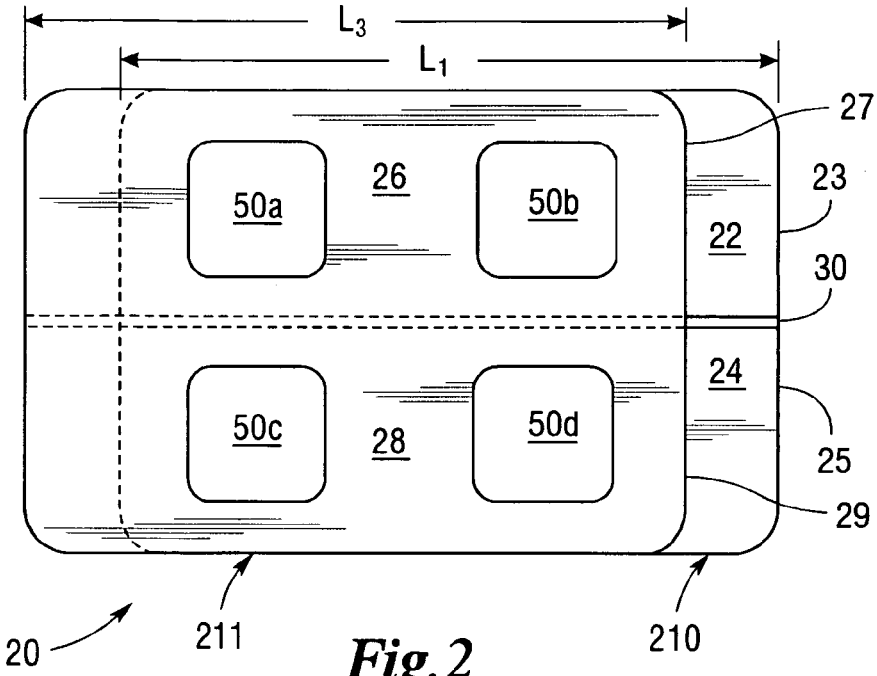
FIG. 2 is a top view of the first embodiment.
Figure 3:
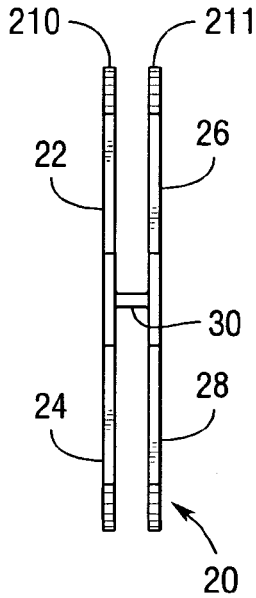
FIG. 3 is an end view of the first embodiment.
Figure 4:
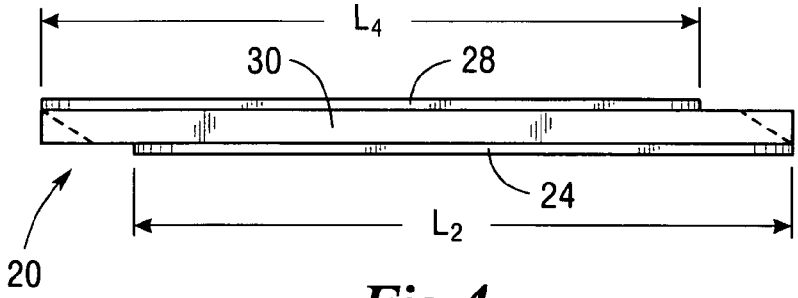
FIG. 4 is a side view of the first embodiment.

A first embodiment of the box closure clip of the present invention is depicted in FIGS. 1A-4 generally at 20. The preferred embodiment of box closure clip 20 is rectangular and is shown with rounded corners. However, it will be appreciated that if this part is extruded in order to minimize production costs, rounding of the corners will involve a secondary machining operation which may significantly impact the cost of the item, in which case, it may become too expensive an option. A first laterally extending surface 22 having a first length $L_1$ (FIG. 2) is intended to underlie at least a first flap 13 of box 11 and second laterally extending surface 24 having a second length $L_2$ (FIG. 4) is designed to underlie at least one other flap 15. A third laterally extending surface 26 having a third length $L_3$ is designed to overlie at least one first flap 13 while fourth laterally extending surface 28 having a length $L_4$ overlies at least one other flap 15. In this preferred embodiment, first edge 23 of first surface 22 and second edge 25 of second surface 24 extend beyond the lead edges 27 of surface 26 and 29 of surface 28 to facilitate insertion of box clip 20 into engagement with box 11. Together, first surface 22 and second surface 24 define first flange 210 while third surface 26 and fourth surface 28 define second flange 211. Vertically extending rib 30 extends between the juncture of first surface 22 and second surface 24 to the juncture between third surface 26 and fourth surface 28 at least for the length of $L_1$. Most boxes have a slight tolerance between the ends of flaps 13, 15 and the thickness of rib 30 is designed to fit in the space created by that tolerance. Even should flaps be designed to butt against each other, the flex at the fold of flaps 13, 15 will easily accommodate the thickness of rib 30. As shown in FIG. 4, rib 30 extends throughout the length of box clip 20, that is $L_2$ plus the overlap differential of $L_4$. If, as is preferred, box clip 20 is manufactured by extrusion to minimize manufacturing costs, the rib 30 will most likely be cut on the diagonal formed by the offset of $L_1$ relative to $L_3$ (as shown by dotted lines). The nose 32 on rib 30 (whether it is vertical or angled), facilitates insertion between flaps 13, 15 and the advance of leading edges 23, 25 facilitates insertion under those flaps 13, 15. The relief openings 50*a*, 50*b*, 50*c*, 50*d* are provided in surfaces 26, 28 (and may also be inserted in surfaces 22, 24) to reduce the material cost of the end product. However, depending on the price of the material versus the labor cost of the post-molding removal operation (for an extruded box clip 20), the openings may be omitted to provide the lowest cost end product.

Figure 5:
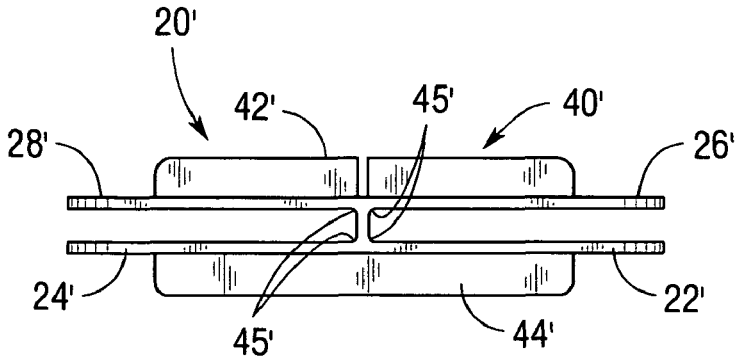
FIG. 5 is an end view of a second embodiment.
Figure 6:
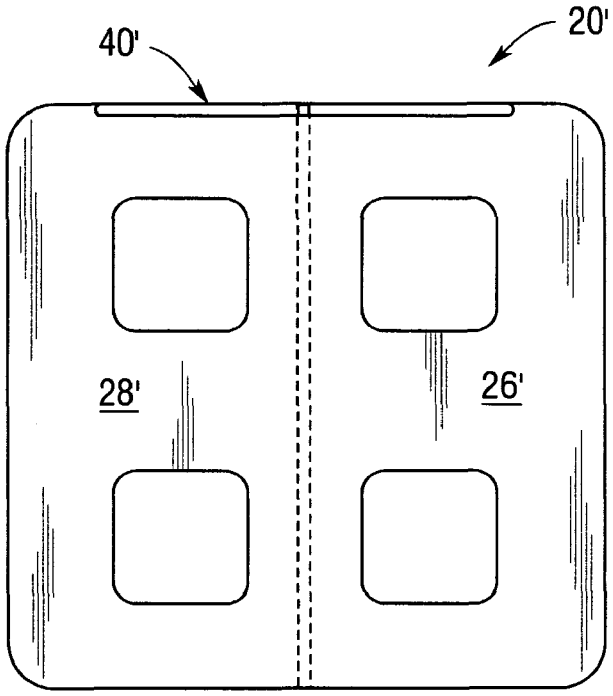
FIG. 6 is a top view of the second embodiment.
Figure 7:
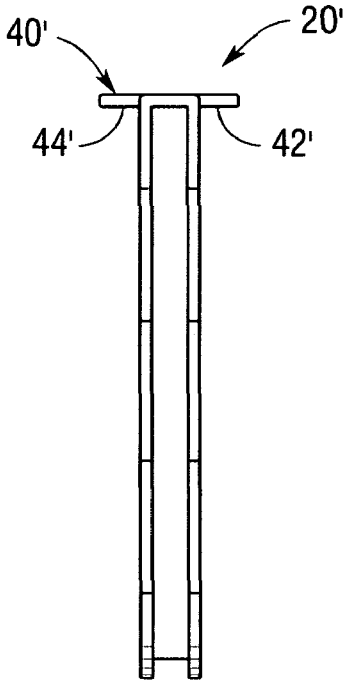
FIG. 7 is a side view of the second embodiment.

A second embodiment of the box clip of the present invention is shown in FIGS. 5-7 generally at 20'. Although the setback feature of surfaces 26' and 28' relative to surfaces 22' and 24' is not shown in this embodiment, clearly such a feature could be added. This second embodiment would have to be manufactured by injection molding, rather than extrusion molding and would, therefore, have a higher cost. As seen in FIG. 5, each of the junctures of rib 30' with surfaces 22', 24', 26', and 28' is provided with a fillet 45' to strengthen the joint and reduce the risk of breakage. This second embodiment has an endstop 40' with a first portion 42' which extends upwardly from surfaces 26', 28' and a lower portion 44' that extends downwardly from surfaces 22', 24'. The extensive length of lower portion 44' allows a box to be constructed using only two closure clips 20' and two closure clips 20" as hereafter described, obviating the need for tape. The extensive width of lower portion 44' provides stability to the box, reducing or eliminating the tendency of the box to torque. The purpose of endstop 40' is to limit movement of a box stacked atop the box to which box clip 20' is attached from sliding axially relative thereto. While it is intended that lower portion 44' be snugged against the exterior sidewall of the shipping carton, to create a more stable stacking, it would be possible to insert lower portion 44' within the sidewall of the box. An adaptation in the end flaps (a slit) would be needed to permit this alternative configuration.

Figure 8:
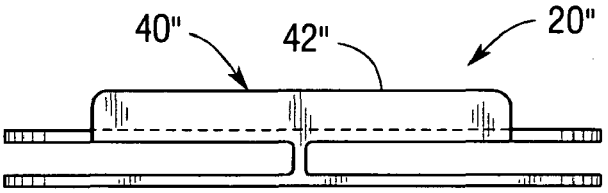
FIG. 8 is an end view of a third embodiment.

The third embodiment of closure clip 20" is shown in FIG. 8. In this embodiment, there is no lower portion corresponding to 44' in the second embodiment, only the upper portion 42". This allows closure clip 20" to be used on the bottom of the box without having a protrusion extending below the bottom of the box 11 which would interfere with its handling on conveyors, and the like, as well as prevent it sitting flush on a shelf.

Figure 9:
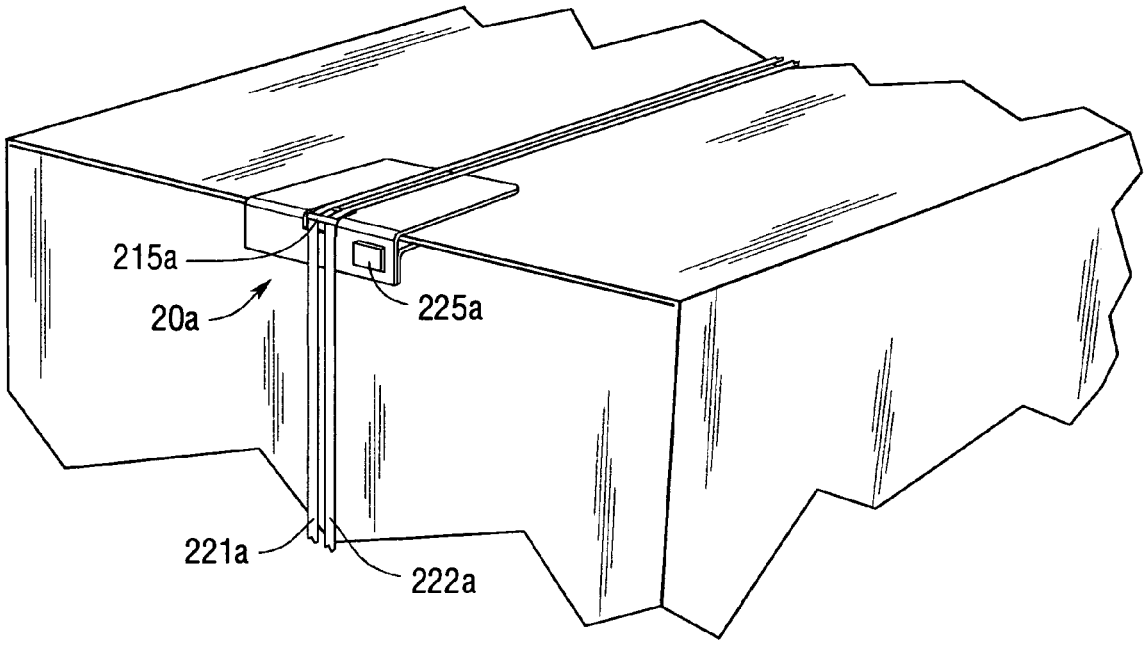
FIG. 9 is a partial perspective view of a fourth embodiment of a box closure clip in use.
Figure 10:
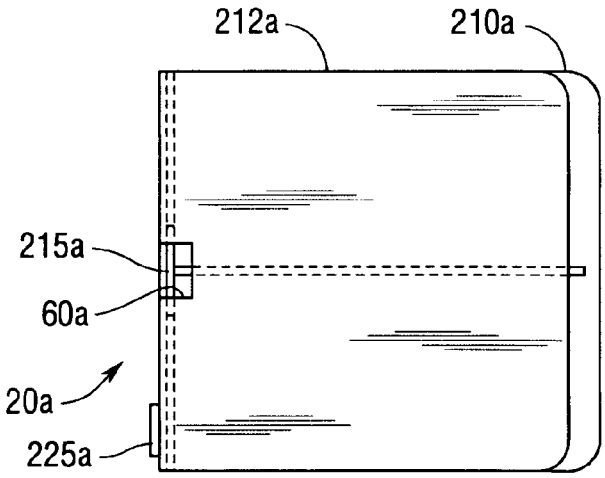
FIG. 10 is a bottom view of the fourth embodiment.
Figure 11:
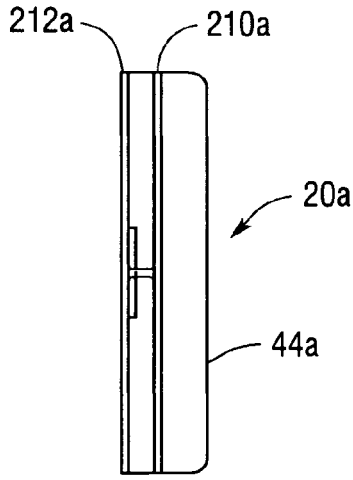
FIG. 11 is an end view of the fourth embodiment.
Figure 12:
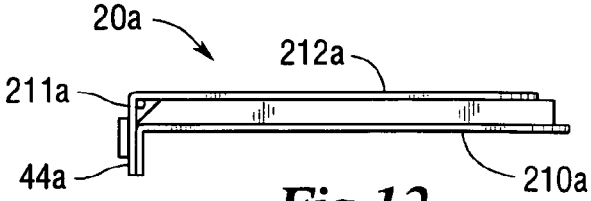
FIG. 12 is a side view of the fourth embodiment.

A fourth embodiment of the box closure clip of the present invention is depicted in FIGS. 9-12 generally at 20*a*. In addition to first flange 210*a* and second flange 212*a*, this embodiment has an end wall 211*a* that interconnects flanges 210*a* and 212*a*. While the embodiment depicted in FIGS. 9-12 is constructed of sheet metal and, hence, lower portion 44*a* of endstop is shown with a doubled wall, this part may also be manufactured of a durable, high-strength plastic material, as the earlier embodiments in which case the innermost of the two walls may be eliminated. Recess 60*a* is formed at the juncture of end wall 211*a* and flange 212*a* with a bar 215*a* extending across an upper reach of recess 60*a*. Binder strap means 220*a*, which may take the form of a single wide strap or, as shown in FIG. 9, parallel narrow binder straps 221*a* and 222*a* to secure closure clip 20*a* in place against tampering and inadvertent movement. For some applications, the bar 215*a* can be optional with the edges of recess 60*a* providing adequate resistance to the movement of binder strap means 220*a*.

Figure 13:
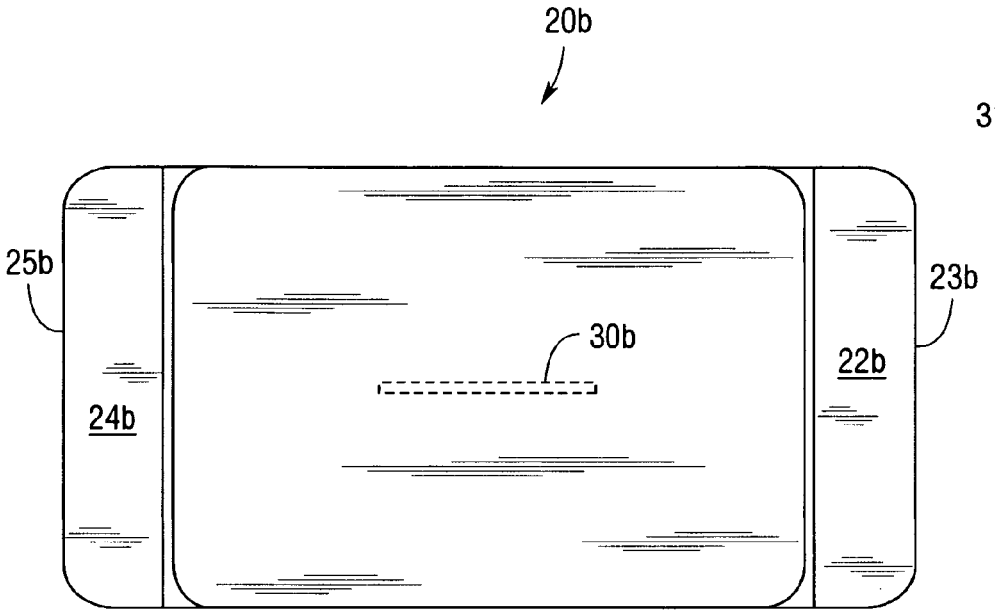
FIG. 13 is a top view of a fifth embodiment.
Figure 14:
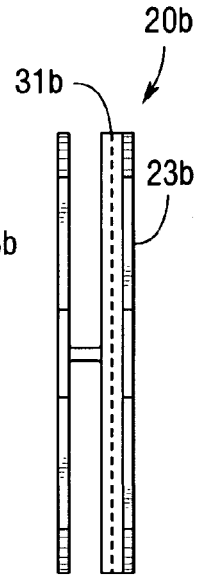
FIG. 14 is an end view of the fifth embodiment.
Figure 15:
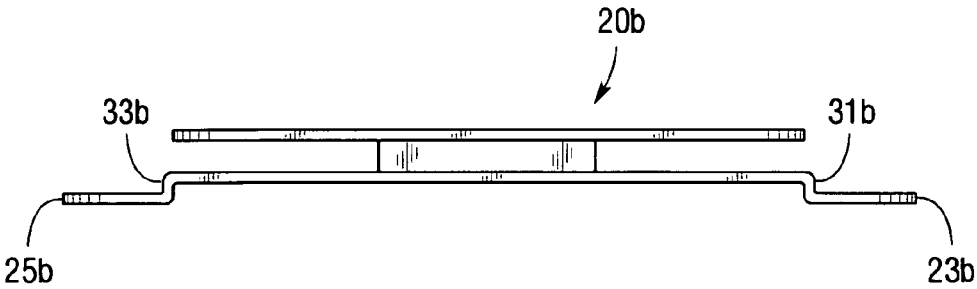
FIG. 15 is a side view of the fifth embodiment.

Some companies, particularly those involved in the container shipping industry, have their own tracking and security technology incorporated into the banding system. For those who do not, it would be within the scope of the present invention to affix a scanable, programmable tracking and security chip 225*a* via an adhesive or molding into the plastic. A fifth embodiment is shown in FIGS. 13-15 generally at 20*b*. The rationale for this embodiment is that it is proposed to utilize two box closure clips 20 in lieu of taping the box. Some of the boxes, depending on their size, show a certain amount of dimensional instability, particularly torquing about the z-axis. At least one of the first and second laterally extending surfaces 22*b*, 24*b*, and more preferably, both surfaces, have edges 23*b* and 25*b* which are stepped downwardly (FIG. 15). This forms shoulders 31*b*, 33*b* which are adapted to fit between and engage side flaps (not shown) which are folded in under end flaps 13, 15. The distance between shoulders 31*b*, 33*b* will be precisely dimensioned to accommodate the distance between side flaps so as to stabilize the box against the torquing which would otherwise occur. The interconnecting flange or rib 30*b* has been foreshortened to allow either shoulder 31*b*, 33*b* to be "ducked under" side flap as box closure clip 10*b* is slid into place between flaps 13, 15. It will be understood that the foreshortening has been exaggerated in FIGS. 13-15 for emphasis and that rib 30*b* will undoubtedly need to be longer than shown to provide adequate stability. It will be understood that the dimensions (length and thickness) or rib 30*b* can be adjusted to provide the box closure clip 20*b* with the strength and stability desired for the specific application. The tendency of the end flaps 13, 15 to flex open (upwardly) will have a tendency to lift the shoulders 31*b*, 33*b* upwardly into the gap between the side flaps and provide the desired stability to the box.

Box closure clip 20 of the present invention provides a secure method of closure for shipping containers which may be manufactured from a durable plastic material by means of extrusion. Accordingly, clip 20 can be produced inexpensively and enables the boxes to readily be reused without being reformulated through the recycling process. In certain industries including retail sales, the shipping industry, food wholesaling and restaurant services, shipping container recycling can result in a significant budgetary savings. Box closure clip 20 makes that possible.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A closure clip for retaining multiple flaps of a box closed, said closure clip comprising:

a) a first substantially rectangular lower support surface having a leading edge, an opposing trailing edge and two side edges connecting said leading and trailing edges, said lower support surface adapted to underlie at least two upper flaps of the multiple box flaps, b) a second substantially rectangular upper surface having a leading edge, an opposing trailing edge and two side edges connecting said upper surface leading and trailing edges, said upper surface adapted to overlie at least two upper flaps of the multiple box flaps, c) a generally vertically extending central rib interconnecting said upper and lower surfaces and extending in an axial direction between the upper and lower surfaces, wherein said side edges of said lower support surface are substantially laterally aligned with said side edges of said upper support surface and said leading edge of said lower support surface extends laterally outwardly beyond the leading edge of said upper support surface, said generally vertically extending rib extending laterally outwardly beyond the leading edge of said upper support surface to facilitate insertion of the clip between at least two of the multiple box flaps.

2. The closure clip of claim 1 wherein said trailing edge of said lower support surface underlies and is axially offset from said third trailing edge of said second upper surface.

3. The closure clip of claim 2 wherein said first leading edge is axially offset from said second leading edge by an amount equal to and in a direction opposite an amount said first trailing edge is axially offset from said second trailing edge whereby said closure clip is invertible having an identical configuration bottom-side up as right-side up.

4. A closure clip for retaining multiple flaps of a box closed, said closure clip comprising:

a) a first substantially rectangular lower support surface having a leading edge, an opposing trailing edge and two side edges connecting said leading and trailing edges, said lower support surface adapted to underlie at least two upper flaps of the multiple box flaps, b) a second substantially rectangular upper surface having a leading edge, an opposing trailing edge and two side edges connecting said upper surface leading and trailing edges, said upper surface adapted to overlie at least two upper flaps of the multiple box flaps, c) a generally vertically extending central rib interconnecting said upper and lower surfaces and extending in an axial direction between the upper and lower surfaces, wherein said side edges of said lower support surface are substantially laterally aligned with said side edges of said upper support surface and said lower support surface extends laterally outwardly beyond the leading edge of said upper support surface, said trailing edge of said lower support surface forming an edge of a downwardly offset shoulder extending in a plane substantially parallel to a plane extending through an adjacent portion of said lower support surface, said offset shoulder adapted to engage an edge of an inwardly directed lower side flap of the multiple flaps to provide torsional stability to the box.

5. The closure clip of claim 4 further comprising a recess through said downwardly offset shoulder, binder strap means extending through at least a portion of said recess, said binder strap means securing the box against unauthorized access.

6. The closure clip of claim 5 further comprising a bar extending over an upper reach of said recess to securely retain binder strap means in place in said recess.

7. The closure clip of claim 5 further comprising a programmable and scanable chip affixed to an external surface portion of said clip to facilitate tracking of the box.

8. The closure clip of claim 5 further comprising a programmable and scanable chip affixed to an external surface portion of said clip to facilitate tracking of the box.

9. The closure clip of claim 4 wherein said generally vertically extending rib is foreshortened to facilitate insertion of said closure clip between the side flaps of the box.

* * * * *